US009945326B2

(12) United States Patent
Halfmann et al.

(10) Patent No.: US 9,945,326 B2
(45) Date of Patent: Apr. 17, 2018

(54) AUTOMATIC CHOKING MECHANISM FOR INTERNAL COMBUSTION ENGINES

(71) Applicant: Briggs & Stratton Corporation, Wauwatosa, WI (US)

(72) Inventors: Aaron Halfmann, West Bend, WI (US); Kyle Clasen, Hartland, WI (US); Matthew Martinek, Cedarburg, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 15/148,746

(22) Filed: May 6, 2016

(65) Prior Publication Data

US 2016/0326988 A1 Nov. 10, 2016

Related U.S. Application Data

(60) Provisional application No. 62/158,375, filed on May 7, 2015.

(51) Int. Cl.

| | |
|---|---|
| ***F02D 41/06*** | (2006.01) |
| ***F02M 1/10*** | (2006.01) |
| ***E01H 5/09*** | (2006.01) |
| *F02M 1/08* | (2006.01) |

(52) U.S. Cl.

CPC ..... *F02M 1/10* (2013.01); *E01H 5/098* (2013.01); *F02M 1/08* (2013.01)

(58) Field of Classification Search

CPC ..... F02D 9/1065; F02M 1/02; F02M 1/08; F02M 1/10; F02M 1/12; F02M 35/1017; F02N 1/084; F02N 2019/002; F02N 19/00; F02N 11/087; F02N 5/02

USPC ..... 37/257, 244, 248; 123/337, 179.18, 123/179.29; 261/39.1, 39.3, 39.6, 52

See application file for complete search history.

(56) References Cited

U.S. PATENT DOCUMENTS

| | | | |
|---|---|---|---|
| 1,139,851 | A | 5/1915 | Dayton |
| 1,334,555 | A | 3/1920 | Robbins et al. |
| 1,851,711 | A | 3/1932 | Linga |
| RE18,731 | E | 2/1933 | Weatherhead, Jr. |
| 2,017,239 | A | 10/1935 | Fitzgerald |
| 2,127,653 | A | 8/1938 | Sisson |

(Continued)

FOREIGN PATENT DOCUMENTS

| | | | |
|---|---|---|---|
| GB | 0 186 716 | A | 10/1922 |

OTHER PUBLICATIONS

U.S. Appl. No. 13/371,051, filed Feb. 10, 2012, Visuri et al.

*Primary Examiner* — Robert E Pezzuto
(74) *Attorney, Agent, or Firm* — Foley & Lardner LLP

(57) ABSTRACT

An air/fuel mixing apparatus configured for use with an internal combustion engine including a carburetor including a body defining a passageway therethrough and a choke valve positioned in the passageway, a solenoid, and a thermal switch configured to energize or de-energize the solenoid. The solenoid is configured to move the choke valve between the choke open position and the choke closed position, wherein the solenoid includes a rotary shaft coupled to a choke lever, and a thermostatic element coupled to the rotary shaft. The thermostatic element expands and constricts based on a temperature of the engine and restricts the movement of the choke valve between the choke closed position and a partially-open position when the solenoid is not energized.

14 Claims, 12 Drawing Sheets

(56) References Cited

U.S. PATENT DOCUMENTS

| | | | | |
|---|---|---|---|---|
| 2,548,334 | A | 4/1951 | Armstrong | |
| 2,764,393 | A | 9/1956 | Geyer | |
| 2,783,984 | A | 3/1957 | Kramer | |
| 2,908,263 | A | 10/1959 | Brown | |
| 2,935,977 | A | 5/1960 | Eberline | |
| 2,979,047 | A | 4/1961 | Rapplean et al. | |
| 3,064,953 | A | 11/1962 | Hayes | |
| 3,118,433 | A | 1/1964 | Lechtenberg | |
| 3,161,186 | A | 12/1964 | Reichenbach et al. | |
| 3,194,224 | A | 7/1965 | Lechtenberg et al. | |
| 3,199,530 | A | 8/1965 | Svendsen | |
| 3,305,223 | A | 2/1967 | Reichenbach | |
| 3,823,700 | A | 7/1974 | Gumtow | |
| 3,863,614 | A | 2/1975 | Thompson et al. | |
| 3,868,935 | A * | 3/1975 | Liebman | F02M 1/10 261/39.3 |
| 4,031,872 | A | 6/1977 | Thompson et al. | |
| 4,038,955 | A * | 8/1977 | Paulmier | F02M 1/12 261/39.1 |
| 4,068,636 | A | 1/1978 | Nau et al. | |
| 4,151,499 | A | 4/1979 | Ganowsky et al. | |
| 4,254,064 | A | 3/1981 | Bernauer et al. | |
| 4,788,014 | A | 11/1988 | Kanno | |
| 4,860,608 | A | 8/1989 | Kobayashi | |
| 5,537,964 | A * | 7/1996 | Hoshiba | F02M 1/12 123/179.18 |
| 5,827,455 | A | 10/1998 | Nakai | |
| 6,114,941 | A | 9/2000 | Scott | |
| 6,116,581 | A | 9/2000 | Watanabe et al. | |
| 6,202,989 | B1 | 3/2001 | Pattullo | |
| 6,752,110 | B2 | 6/2004 | Tharman et al. | |
| 6,990,969 | B2 | 1/2006 | Roth et al. | |
| 7,331,326 | B2 | 2/2008 | Arai et al. | |
| 7,344,125 | B2 | 3/2008 | Matsuda et al. | |
| 7,628,387 | B1 | 12/2009 | Clouse et al. | |
| 8,146,558 | B2 * | 4/2012 | Clouse | F02M 1/10 123/179.18 |
| 8,695,950 | B2 * | 4/2014 | Takesue | F02M 1/10 261/39.3 |
| 8,783,664 | B2 | 7/2014 | Arai | |
| 8,978,622 | B2 * | 3/2015 | Furuya | F02M 1/10 123/179.18 |
| 2005/0144919 | A1 | 7/2005 | Osborne | |
| 2006/0283968 | A1 | 12/2006 | Reichle | |
| 2009/0146327 | A1 | 6/2009 | Roth | |
| 2009/0293828 | A1 | 12/2009 | Iwata et al. | |
| 2009/0299614 | A1 | 12/2009 | Iwata et al. | |
| 2011/0226217 | A1 | 9/2011 | Raasch | |

* cited by examiner

AUTOMATIC CHOKING MECHANISM FOR INTERNAL COMBUSTION ENGINES

CROSS-REFERENCE TO RELATED PATENT APPLICATIONS

This application claims the benefit of U.S. application Ser. No. 62/158,375, filed May 7, 2015, which is incorporated herein by reference in its entirety.

BACKGROUND OF THE INVENTION

The present invention relates to small air-cooled internal combustion engines, especially those utilizing a carburetor, such as engines in a snow thrower, lawn mower, rototiller, log splitter, etc. Cold temperature starting of the engine requires a more fuel-rich fuel-air mixture in the intake manifold of the engine to sustain the combustion reaction. In some engines, this is done by manually closing a choke valve in the carburetor, thereby partially choking off the air supply to the engine. As the engine warms up, the choke is no longer necessary because the increased temperatures in the engine help to sustain the combustion reaction and thus the choke is opened, allowing more air into the intake manifold. In many small engines, the choke valve is actuated manually, but may be actuated automatically, either mechanically or electrically.

Typically, during warm engine restarts, the carburetor's choke valve must remain open to start the engine and to prevent the engine from stumbling or stalling. During cold starts, if the choke valve is opened too soon, the engine may stall because the fuel-air mixture is not rich enough to sustain the reaction. Conversely, if the choke remains closed too long, the engine may also stumble and excessive hydrocarbon emissions and fouling of the spark plug can occur.

To prevent the choke valve from being in an incorrect position either during cold engine starts or warm engine restarts, various automatic choking mechanisms have been developed, including that disclosed in commonly-owned U.S. Pat. No. 7,628,387, incorporated entirely herein by reference. FIG. 1 illustrates an air/fuel mixing apparatus 5 of U.S. Pat. No. 7,628,387. Air/fuel mixing apparatus 5 includes a carburetor 10 and a solenoid 118 and is configured for use in outdoor power equipment. The carburetor 10 includes a body 14 defining an air/fuel passageway 18 along a central axis 22. A throttle lever 30 is coupled to a throttle valve (not shown) via a throttle shaft (also not shown) such that the throttle valve is pivotable about an axis substantially normal to the central axis 22 of passageway 18. Additionally, a choke lever 46 is coupled to a choke shaft (not shown), which is in turn coupled to a choke valve (not shown) that is configured to be pivotable substantially normal to central axis 22 in passageway 18 to enable restriction of air flow through passageway 18. As is set forth in detail in U.S. Pat. No. 7,628,387, throttle lever 30 and choke lever 46 each interact with respective cam surfaces to control and alter the amount of throttle and choke restriction in passageway 18.

When the engine has started and reached its normal operating temperature, a rotary solenoid 118 may be activated to further pivot choke lever 46 via a lever 122 to disengage choke lever 46 from throttle lever 30 and maintain the choke valve in a substantially opened position. A thermal switch 134 is operably coupled in circuit with the solenoid 118 and a power source 128 (e.g., a battery, a DC power source, or engine stator). The thermal switch may be surface mounted to any of the exhaust components of the engine (e.g., the muffler), or positioned in the exhaust stream of the engine (e.g., in an exhaust manifold of the engine), to detect exhaust temperature of the engine, which is indicative of the operating temperature of the engine. Thermal switch 134 is normally open, such that the solenoid 118 remains de-energized when the ambient temperature or exhaust temperature of the engine is below a predetermined value (e.g., during an initial cold start of the engine or engine restart). After the ambient or exhaust temperature reaches the predetermined value, however, the thermal switch 124 closes to energize the solenoid 118 which, in turn, pivots the choke lever 46 to place the choke valve in a substantially-opened position.

During hot restart of the engine, thermal switch 134 will be closed above a predetermined temperature value. As such, immediately upon engine starting, power is supplied to the solenoid 118 to energize the solenoid 118, which will again pivot the choke lever 46 such that the choke valve is maintained in a substantially-opened position. While such a configuration may work well for most engine applications, cold-weather applications, such as use on a snow thrower at ambient temperatures generally below 40° F., presents unique challenges. In such cold-weather applications, the engine generally needs at least a small amount of choke to adequately start, even under hot restart conditions. Air/fuel mixing apparatus 5 of U.S. Pat. No. 7,628,387 only enabled solenoid 118 to substantially open the choke valve under hot restart conditions. Accordingly, it would be advantageous to have an air/fuel mixing apparatus for use in cold-weather applications having the ability to apply a variable choke amount under such hot restart conditions.

SUMMARY

One embodiment of the invention relates to an air/fuel mixing apparatus configured for use with an internal combustion engine. The air/fuel mixing apparatus includes a carburetor including a body defining a passageway therethrough and a choke valve positioned in the passageway. The choke valve is rotatable about a first vertical axis in response to movement of a choke lever between a choke open position and a choke closed position. The air/fuel mixing apparatus further includes a solenoid configured to move the choke valve between the choke open position and the choke closed position, wherein the solenoid includes a rotary shaft coupled to the choke lever, and a thermostatic element attached to the rotary shaft, wherein the thermostatic element expands and constricts based on a temperature of the engine, wherein the thermostatic element restricts the movement of the choke valve between the choke closed position and a partially-open position when the solenoid is not energized, and a thermal switch coupled to the solenoid configured to open below a predetermined temperature and close above the predetermined temperature, wherein the thermal switch is configured to de-energize the solenoid when open and energize the solenoid when closed thereby moving the choke valve to the choke open position.

Another embodiment of the invention relates to a snow thrower including an auger configured to gather snow, a chute configured to discharge snow, an engine, a solenoid, and a thermal switch. The engine includes a carburetor including a choke valve, wherein the choke valve is rotatable between an open position and a closed position. The solenoid is configured to move the choke valve between the open position and the closed position, wherein the solenoid includes a rotary shaft coupled to a choke lever, a thermostatic element coupled to the rotary shaft, wherein the thermostatic element expands and constricts based on a temperature of the engine, wherein the thermostatic element restricts the movement of the choke valve between the closed position and a partially-open position when the solenoid is not energized, and a thermal switch coupled to the solenoid configured to open below a predetermined temperature and close above the predetermined temperature, wherein the thermal switch is configured to de-energize the solenoid when open and energize the solenoid when closed thereby moving the choke valve to the open position.

Alternative exemplary embodiments relate to other features and combinations of features as may be generally recited in the claims.

DETAILED DESCRIPTION OF THE INVENTION

Figure 2:
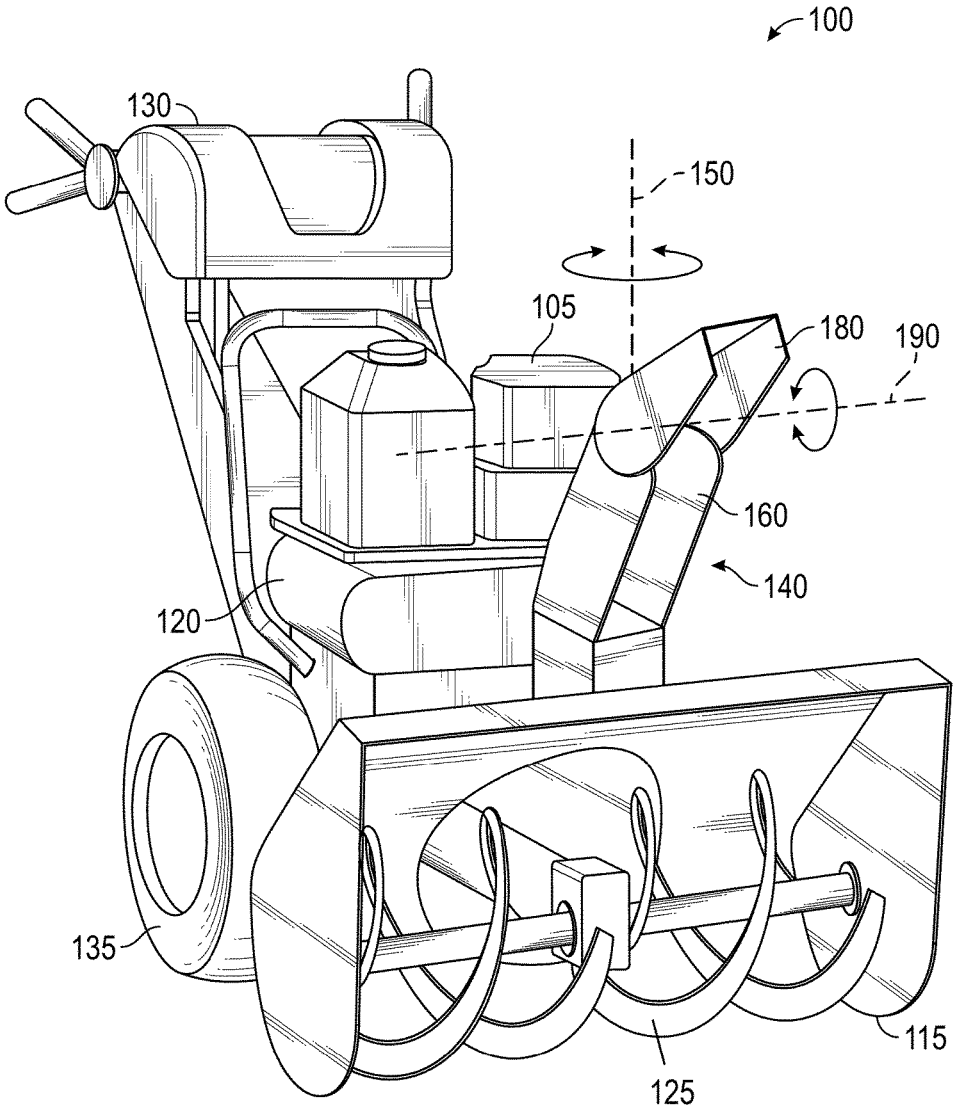
FIG. 2 is a perspective view of a snow thrower, according to an exemplary embodiment.

Referring to FIG. 2, a snow thrower 100 is illustrated. In an example application, the automatic choking mechanism is used in connection with a snow thrower 100. In other applications, the automatic choking mechanism can be used in connection with any other outdoor power equipment utilizing a carburetor, including, but not limited to, a lawn mower. The snow thrower 100 includes a body 120, one or more wheels 135, a chute 140 rotatable relative to the body 120, a control interface 130, an auger 125, an auger or impeller housing 115, and an engine 105. The control interface 130 controls operation of various components of the snow thrower 100. The auger 125 gathers snow for discharge through the chute 140. In some embodiments, the auger 125 is an auger for a two-stage snow thrower as shown in FIG. 2. In other embodiments, the auger 125 is a paddle of a single stage snow thrower. The chute 140 includes a neck or main portion 160 rotatably coupled to the body 120 for rotation about a vertical axis 150. The chute 140 also includes a deflector 180 rotatably coupled to the neck 160 for rotation about a horizontal axis 190. Snow travels through the neck 160 and is discharged through the deflector 180. The direction of discharge is controlled by the position of the neck 160 relative to the body 120. The angle of discharge is controlled by the position of the deflector 180 relative to horizontal. The automatic choking mechanism can be used to facilitate starting of the engine 105 of the snow thrower 100, particularly during cold ambient temperatures (e.g., less than 40° F.), by controlling the position of the choke valve on the carburetor of the engine 105 to control the amount of air introduced into the carburetor for combustion processes.

Figure 1:
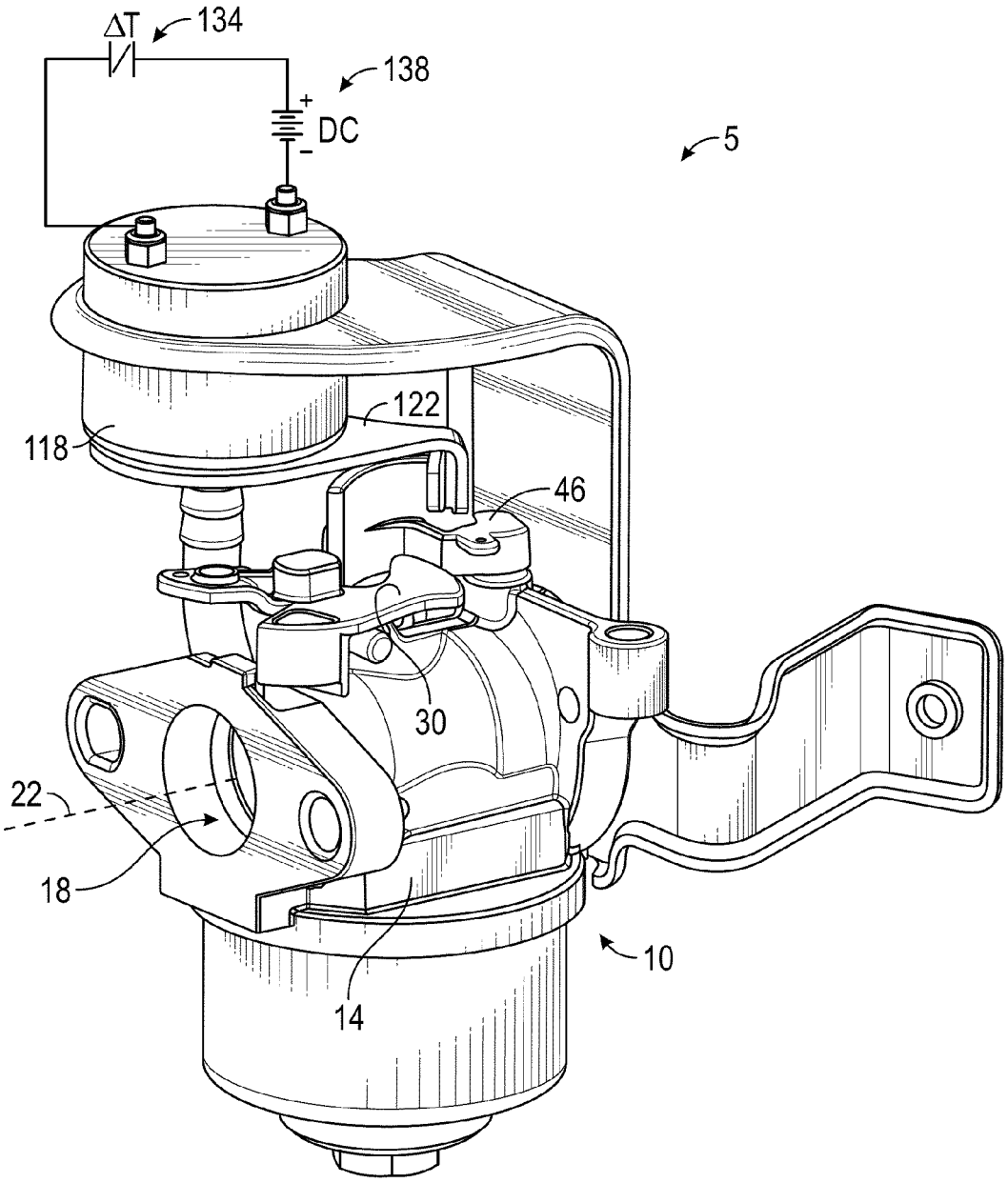
FIG. 1 (Prior Art)
FIG. 1 is an isometric view of an air/fuel mixing apparatus in accordance with the prior art.
Figure 3:
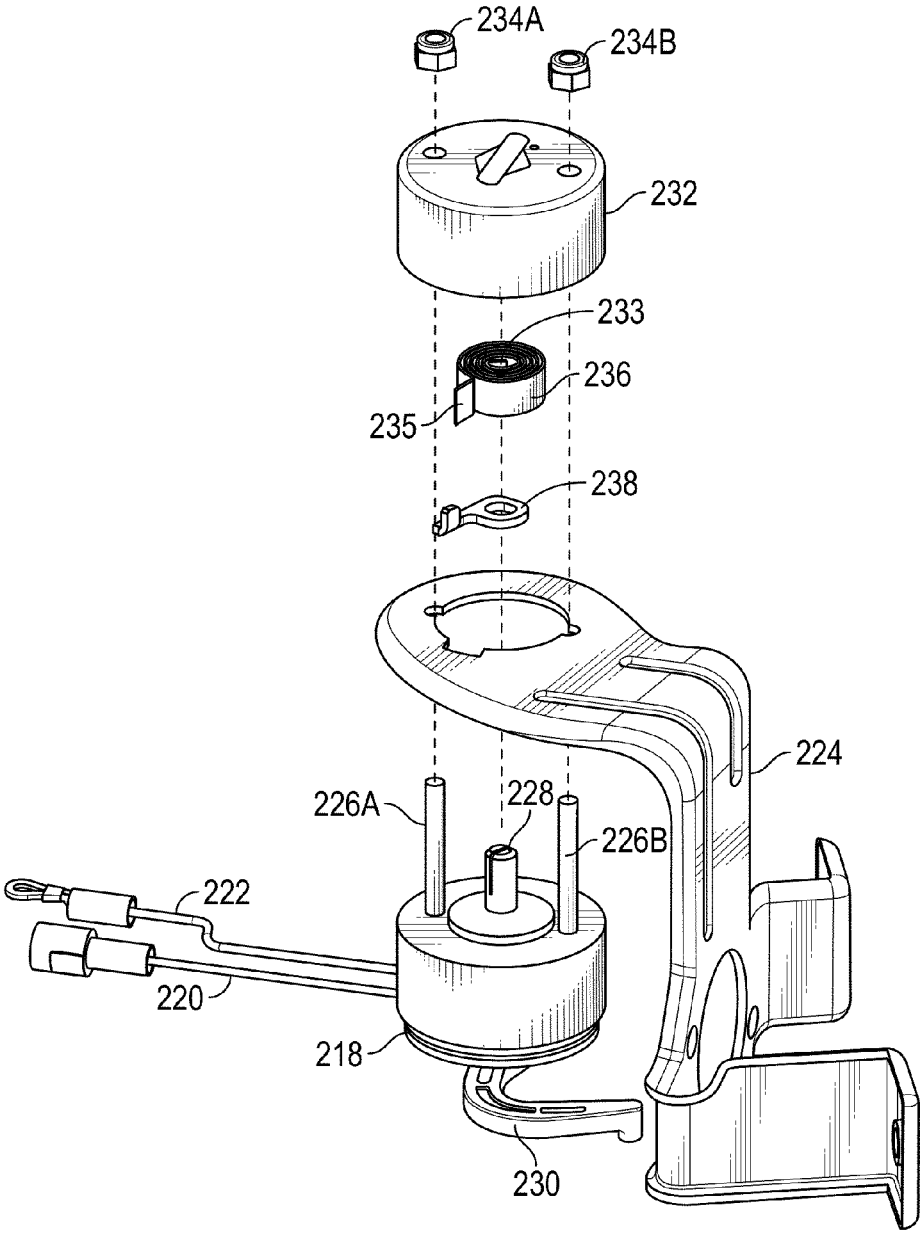
FIG. 3 is an exploded view of a rotary solenoid for an automatic choking system, according to an exemplary embodiment.

Referring to FIG. 3, a rotary solenoid mechanism for use with an automatic choking system for an engine according to an exemplary embodiment is shown. The mechanism includes a rotary solenoid 218 having a power lead 220 and a grounding wire 222 coupled thereto. Power lead 220 is coupled to a power source (e.g., a battery, a DC power source, etc.) and is also in communication with a thermostatic switch (not shown) as described above with respect to FIG. 1. Solenoid 218 is mounted on a bracket 224, which is in turn mounted to a carburetor. Solenoid 218 utilizes respective mounting posts 226A, 226B and a cap 232 to retain solenoid 218 on bracket 224. Cap 232 is retained on posts 226A, 226B via mounting nuts 234A, 234B.

In the carburetor, fuel is mixed with air to produce an air/fuel mixture for combustion in one or more cylinders of the engine 105. The choke valve 244 (shown in FIG. 5B) controls the flow of air into the carburetor and in doing so controls the amount of air in the air/fuel mixture for combustion. As described further herein, controlling the position of the choke valve 244 allows for ease of starting the engine, particularly in relatively cold ambient temperatures (e.g., less than 40° F.). The air/fuel mixture flowing out of the carburetor is controlled by a throttle valve coupled to a throttle lever. The throttle valve is movable between a closed position and a wide-open position. The position of the throttle valve is adjusted so that the engine speed is maintained at a desired engine speed.

Unlike solenoid 118 described above with respect to FIG. 1, solenoid 218 includes a rotary shaft 228 that is both coupled to a lever arm 230 below solenoid 218 and extends through the top surface of solenoid 218. The portion of rotary shaft 228 below the solenoid 218 controls the movement of the lever arm 230, which in turn controls the movement of a choke lever 246 (shown in FIGS. 8-12). The portion of rotary shaft 228 extending through the top of solenoid 218 is further coupled to a thermostatic coil element 236 and a travel regulator 238. As will be described in further detail below, thermostatic coil element 236 and travel regulator 238 act to restrict the amount that the choke valve 244 may be opened when the engine is off prior to hot restart conditions, regardless of the feedback that the thermostatic switch provides to solenoid 218.

The thermostatic coil element 236 expands and constricts in reaction to the surrounding ambient temperature. The thermostatic coil element 236 is wound around the rotary shaft 228 of the solenoid 218 and is attached to the shaft 228 at a fixed tab end 233. Thermostatic coil element 236 further includes a free tab 235 that moves with the expansion and constriction of the thermostatic coil element 236. The free tab 235 extends outward from the thermostatic coil element 236 substantially perpendicular to the axis of the shaft 228 of solenoid 218.

The travel regulator 238 is freely attached to the shaft 228 of the solenoid 218 and rotates with the shaft 228. As described further herein, the travel regulator 238 is configured to restrict the amount of rotation that the thermostatic coil element 236 may impart on the rotary shaft 228. The travel regulator 238 extends outward from the thermostatic coil element 236 substantially perpendicular to the axis of the rotary shaft 228 of solenoid 218.

Figure 4:
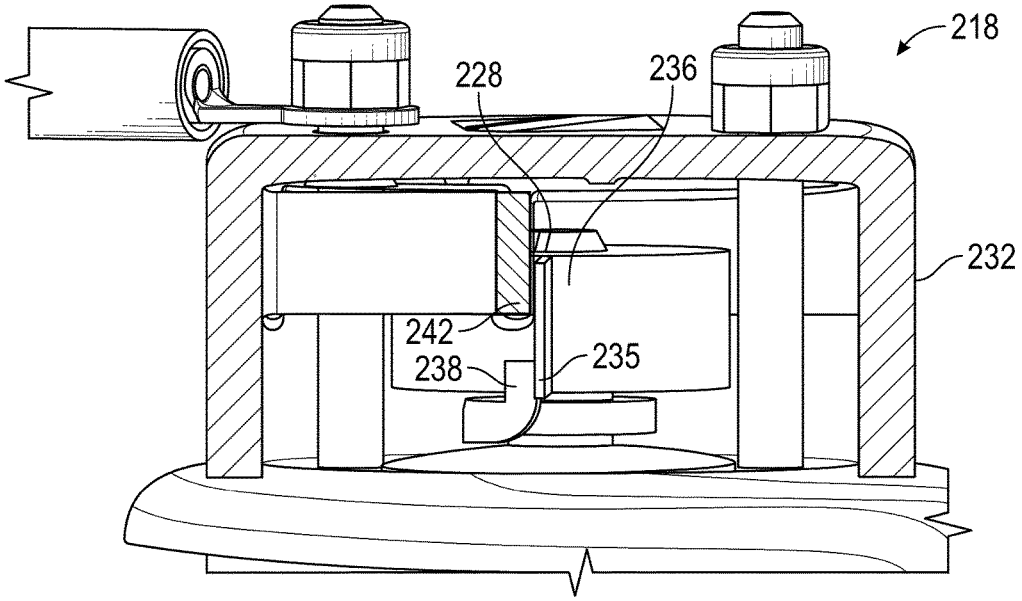
FIG. 4 is a side section view of the rotary solenoid of FIG. 3, according to an exemplary embodiment.

FIG. 4 illustrates a side view of the solenoid 218. The solenoid 218 includes a cap 232. Formed within the cap 232 is a restriction surface 242. As shown, the travel regulator 238 is free to move underneath the restriction surface 242, while the movement of the free tab 235 of the thermostatic coil element 236 is limited in range by the restriction surface 242. In some embodiments, as the thermostatic coil element 236 expands due to increase in temperature, the free tab 235 moves clockwise around the shaft 228 and as the thermostatic coil element 236 constricts due to decrease in temperature, the free tab 235 moves counter-clockwise around the shaft 228. As such, when moving clockwise around the shaft 228 (e.g., when the thermostatic coil element 236 is expanding), the movement of the free tab 235 is limited by the restriction surface 242. In some configurations described further herein, travel regulator 238 comes into contact with the free tab 235 when the free tab 235 is contacting the restriction surface 242, thereby limiting movement of the travel regulator 238 and the shaft 228.

Figure 5A:
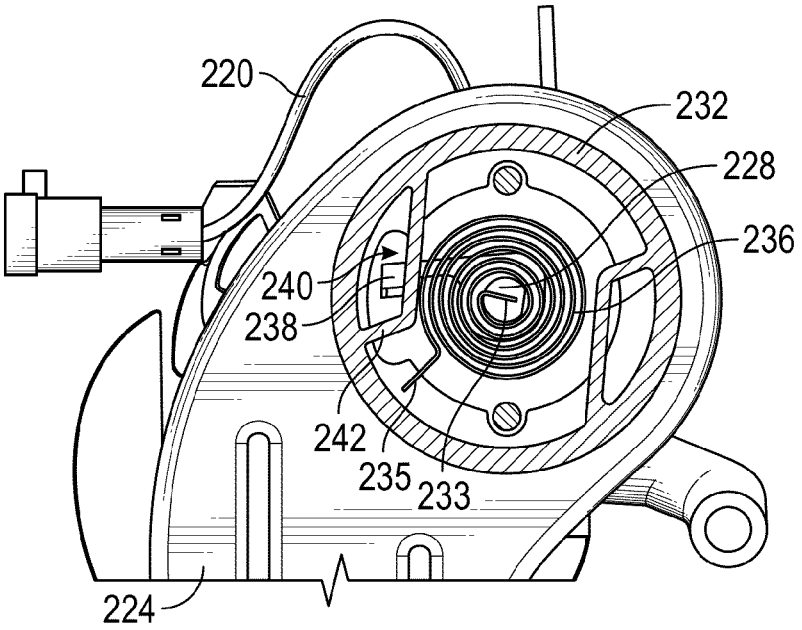
FIG. 5A is a top section view of the rotary solenoid of FIG. 3 in a cold configuration, according to an exemplary embodiment.
Figure 5B:
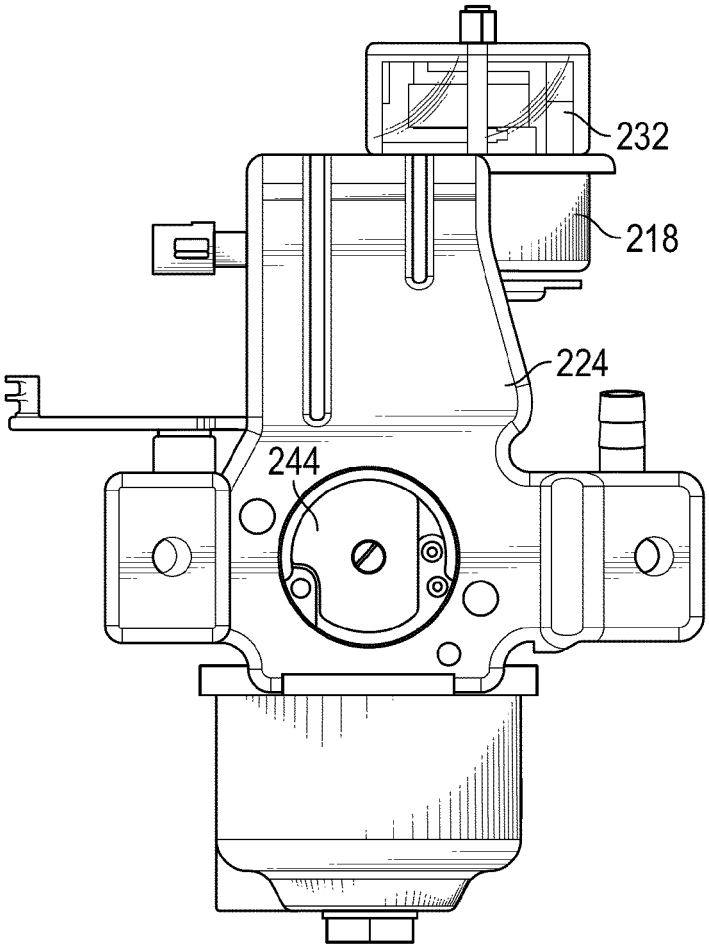
FIG. 5B is a partial side view of an air/fuel mixing apparatus and the rotary solenoid of FIG. 3 in a cold configuration, according to an exemplary embodiment.

FIG. 5A illustrates a top section view of the system described above in FIGS. 3 and 4, while FIG. 5B shows a partial side view of the system under the same conditions. FIG. 5A and FIG. 5B show the system in a "cold" configuration, wherein the engine has not been run for some time such that the engine and surrounding components have substantially cooled. In this scenario, a restart of the engine will not be considered a "hot restart," and as such, it is preferable to provide the choke valve 244 in a substantially fully closed position. FIG. 5A shows thermostatic coil element 236 within cover 232 and coupled to shaft 228 at the fixed end tab 233 via a slot in shaft 228. Travel regulator 238 is also coupled to shaft 228. Cover 232 includes a travel path 240 and restriction surface 242 therein. Travel path 240 is configured to allow travel regulator 238 to rotate freely and underneath the restriction surface 242. Restriction surface 242 is configured to provide a contact point for thermostatic element 236 and specifically, the free tab 235 of the thermostatic element 236, as thermostatic element 236 naturally expands when subjected to elevated ambient temperatures. In a coil-type thermostatic element, this expansion causes thermostatic element 236 to rotate. However, in the scenario shown in FIG. 5A, the ambient temperatures are not elevated to a point that thermostatic element 236 expands so as to contact the travel regulator 238 and rotate the shaft 228. As such, the shaft 228 remains in the same position and does not move lever arm 230 such that choke valve 244 remains in a substantially closed position. Having choke valve 244 in this substantially closed position is preferable when restarting the engine after it has substantially cooled.

Figure 6A:
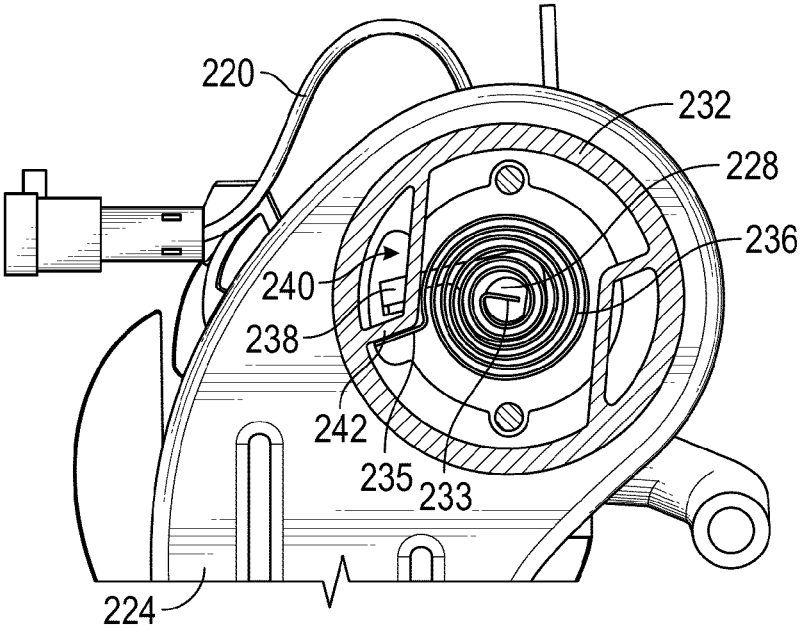
FIG. 6A is top section view of the rotary solenoid of FIG. 3 in a warm configuration, according to an exemplary embodiment.
Figure 6B:
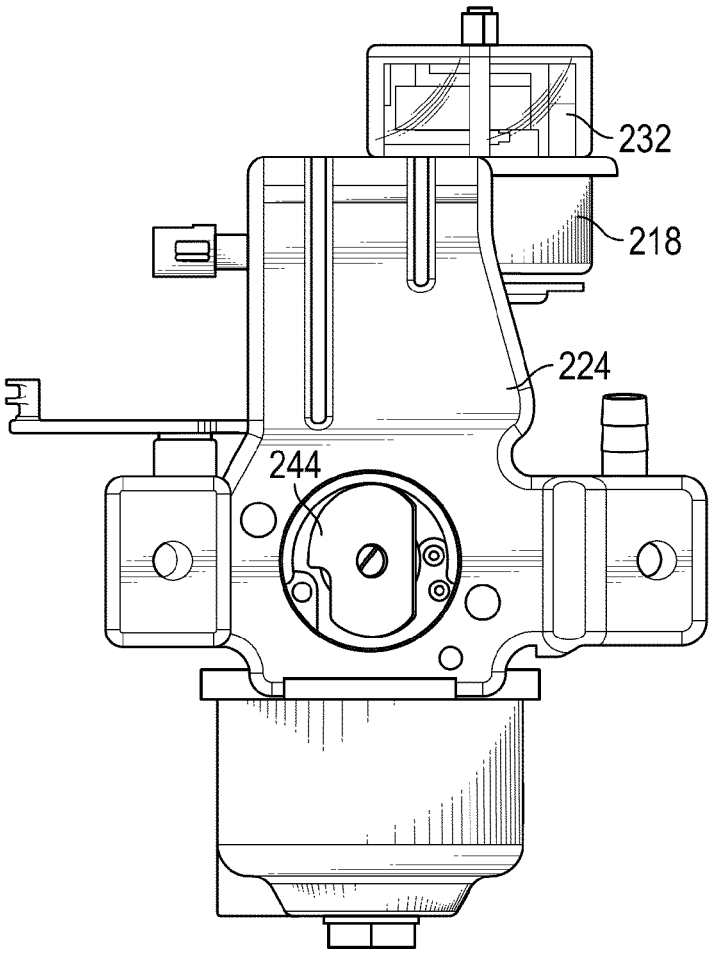
FIG. 6B is a partial side view of the air/fuel mixing apparatus of FIG. 5B and the rotary solenoid of FIG. 3 in a warm configuration, according to an exemplary embodiment.

Turning to FIG. 6A and FIG. 6B, the system in a "warm" configuration is illustrated. In this scenario, the engine may have been turned off but has not entirely cooled. Accordingly, thermostatic element 236 expands and contacts restriction surface 242, thereby acting to rotate shaft 228 in a counter-clockwise direction. This, in turn, acts to hold choke valve 244 slightly open. Travel regulator 238 is still able to travel freely within travel path 240, and thus choke valve 244 may continue to open or close dependent upon the ambient temperature. If the user were to start the engine while the system was in this "warm" configuration, the system would be in a "partially closed" choke position that would be advantageous for restarts in cold weather where the engine has been shut down for some time, but not long enough to fully cool. Conversely, under a hot restart scenario discussed above with respect to FIG. 1, the system would either be in a fully-closed choke position at temperatures below a threshold for activating the thermal switch, or a fully-opened choke position at temperatures above that threshold. Neither scenario is optimal for hot restart conditions in cold weather applications, where cold inlet air necessitates a more fuel-rich mixture for optimal combustion.

Figure 7A:
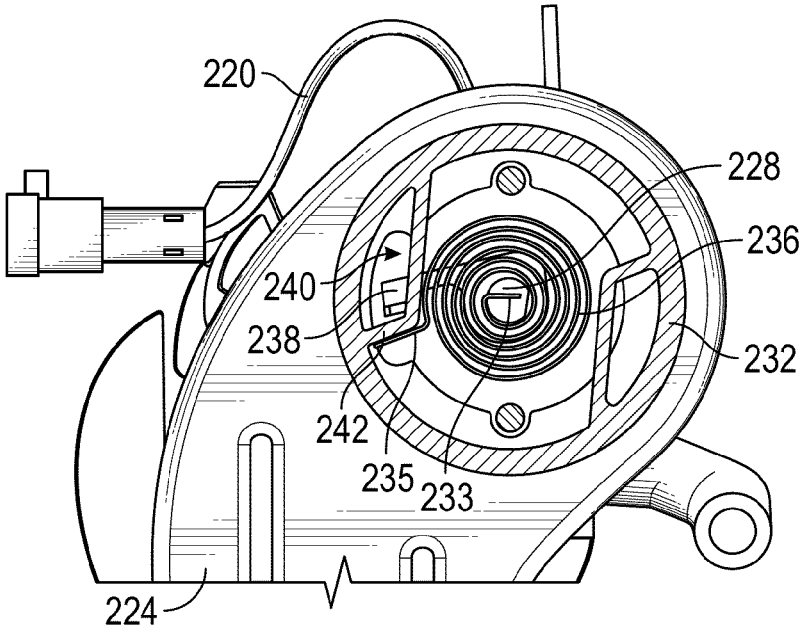
FIG. 7A is top section view of the rotary solenoid of FIG. 3 in a hot configuration, according to an exemplary embodiment.
Figure 7B:
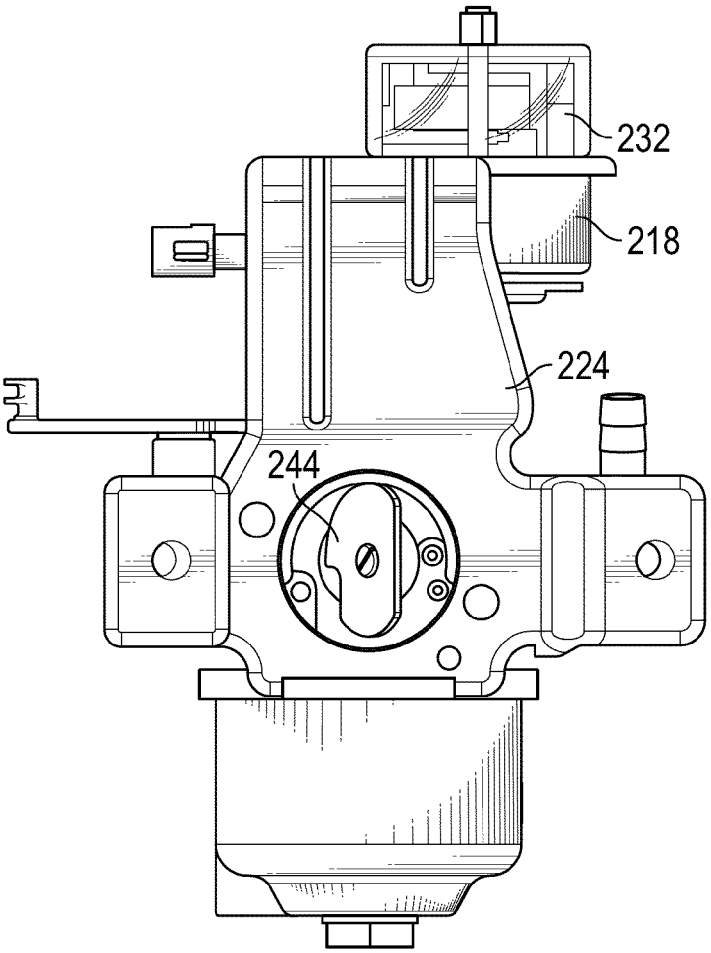
FIG. 7B is a partial side view of the air/fuel mixing apparatus of FIG. 5B and the rotary solenoid of FIG. 3 in a hot configuration, according to an exemplary embodiment.

Referring now to FIG. 7A and FIG. 7B, the system in a "hot" configuration is shown. Under this hypothetical scenario, the engine has only recently shut down, and thus the engine is still hot and ambient temperatures are still elevated. Here, thermostatic element 236 again expands to cause rotation of shaft 228 and thus open choke valve 244 even beyond the "partially opened" position shown in FIG. 6B. However, in this scenario, travel regulator 238 contacts the thermostatic coil element 236 at free tab 235, thereby limiting the overall rotation of shaft 228, and thus limiting the amount that choke valve 244 may be opened. This configuration is desirable because even in hot restart conditions with elevated engine temperatures, it is still desirable to limit the choke valve 244 opening at restart in cold weather applications so that the choke valve 244 is not fully open. As discussed above, conventional hot restart applications do not allow for such a range of variable choke valve control scenarios, as the choke valve is generally held substantially closed or substantially opened.

Figure 8:
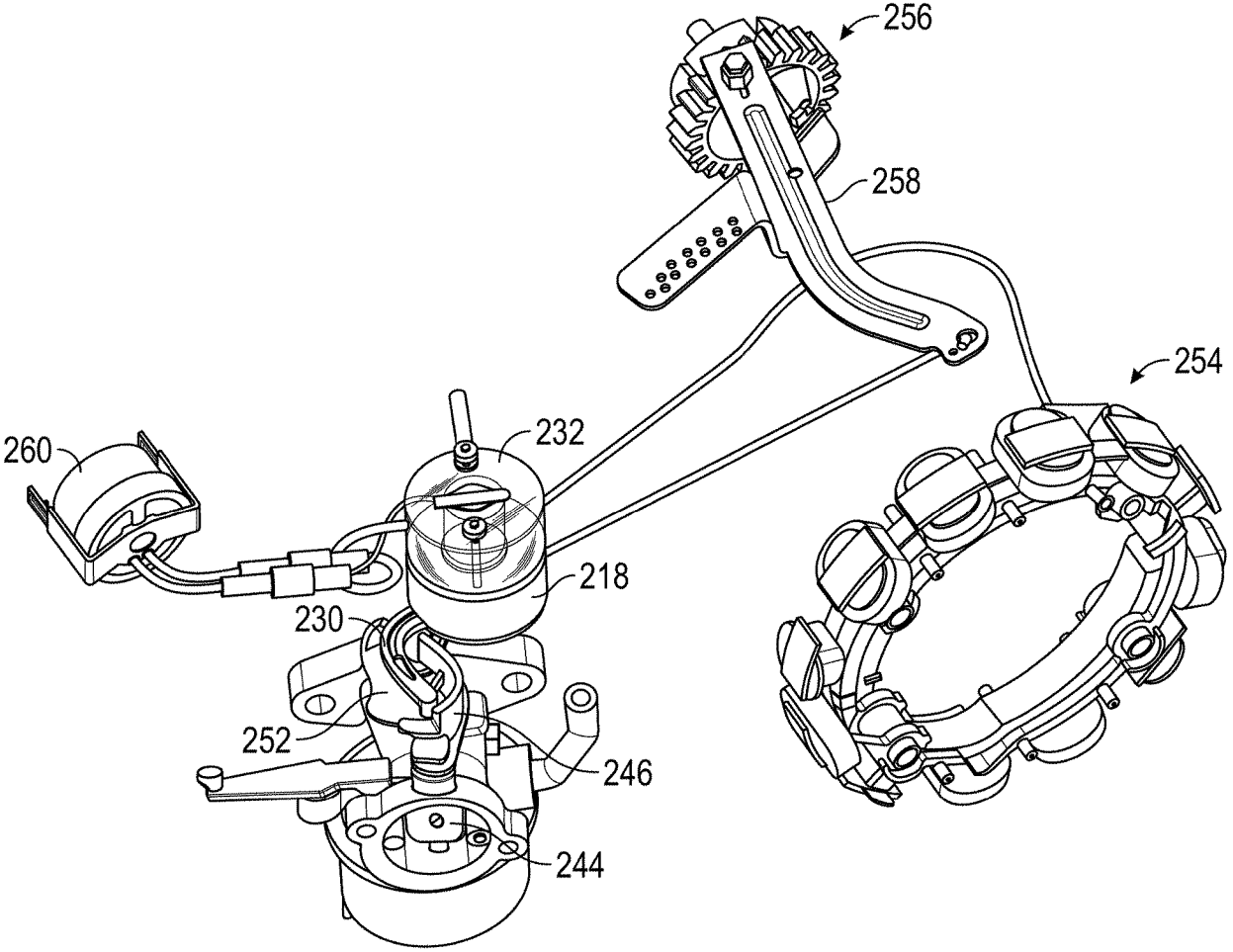
FIG. 8 is a perspective view of the air/fuel mixing apparatus in a cold configuration, according to an exemplary embodiment.

Referring now to FIG. 8, the system under a "cold" configuration is shown. This configuration is similar to the situation in FIG. 5A and FIG. 5B. When the engine is "cold," or has been idle for enough time to substantially cool down, the solenoid 218 is not energized and thermostatic coil element 236 is constricted such that the free tab 235 moves very little, if at all. This causes shaft 228 and lever arm 230 to remain stationary. In turn, lever arm 230 does not move the choke lever 246 and the choke valve 244 remains in a substantially closed position. This allows a fuel-rich air/fuel mixture within the carburetor, which is conducive to starting an engine in relatively cold ambient temperatures.

Other components of the system that are illustrated in FIG. 8 include an alternator 254, governor 256, and governor arm 258. To control engine speed, the governor 256 detects changes in the load on the engine and adjusts the throttle lever 252 accordingly. The throttle lever 252 is coupled to the throttle valve and controls the position (closed to wide-open) of the throttle valve so that the engine speed is maintained at a desired engine speed. For example, referring back to FIG. 2, if the auger 115 of the snow thrower 100 is engaged and gathering snow, the engine 105 will experience a load related to the operation of the auger 115.

Under a light load, the carburetor will need to deliver a relatively small amount of air-fuel mixture to the combustion chamber of the engine. Under a heavier load, the carburetor will need to deliver a relatively larger amount of air-fuel mixture to the combustion chamber of the engine. The governor 256, linked to the throttle lever 252 by the governor arm 258, is configured to adjust the throttle lever 252, and thus, the throttle valve, according to the load on the engine. The alternator 254 is configured to work with the power source 260 to generate electricity for the electrical components of the system.

Figure 9:
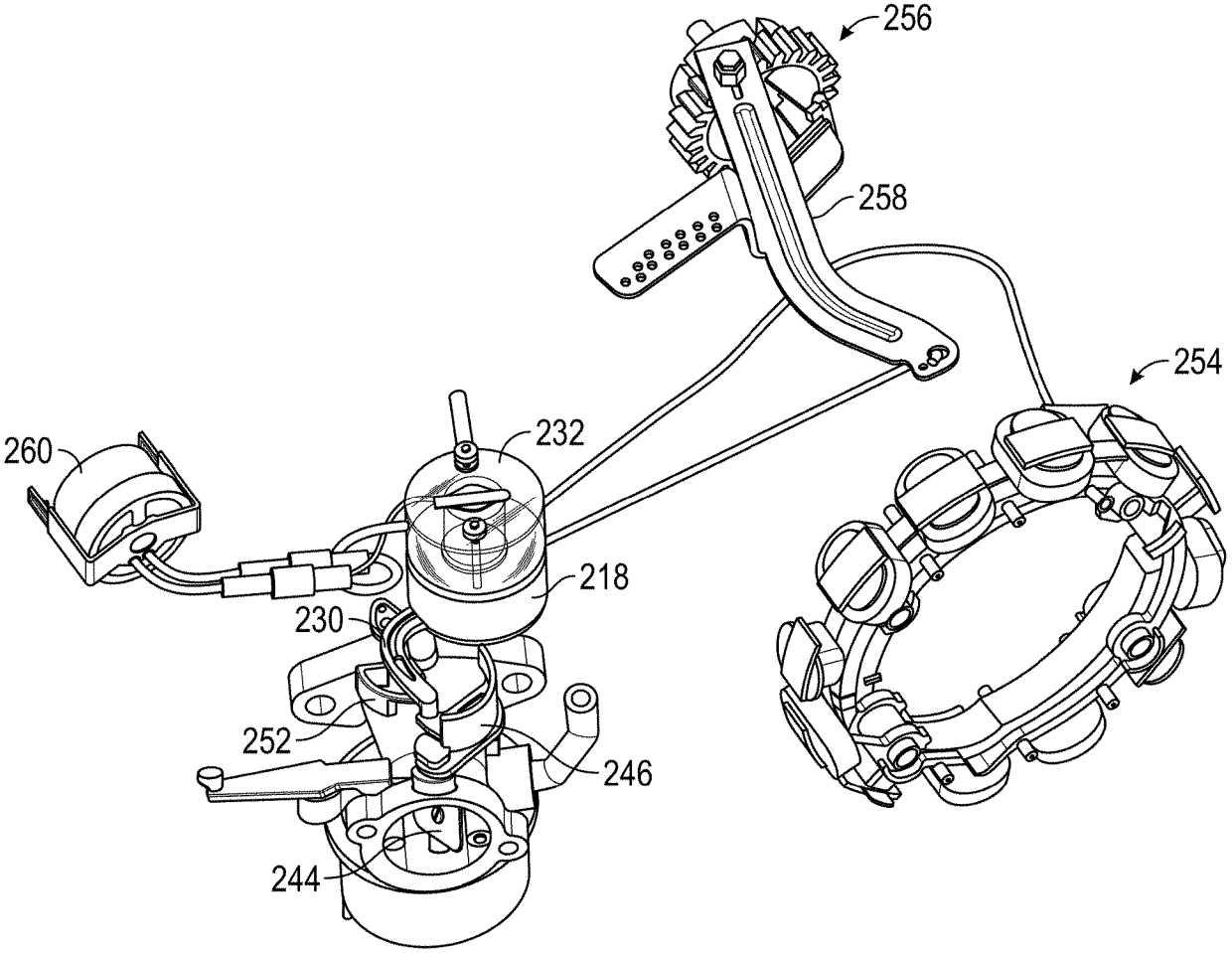
FIG. 9 is a perspective view of the air/fuel mixing apparatus in a warm-up configuration, according to an exemplary embodiment.

Furthermore, FIG. 9 shows the system under a "warm-up" or "run relief" configuration. When the engine is warming up and has just been started from a "cold" configuration, the governor 256 rotates at a no load speed. During the "warm-up" stage the thermostatic coil element 236 starts to expand, moving the free tab 235, which contacts the restriction surface 242 causing the shaft 228 to turn. When the shaft 228 of the solenoid 218 turns, the lever arm 230 is rotated and in turn, moves the choke lever 246 and the choke valve 244 begins to open. The thermal switch coupled to the solenoid 218 detects the ambient temperature or engine exhaust temperature and open or closes depending on that temperature. The thermal switch is normally open, such that the solenoid 218 remains de-energized when the ambient temperature or exhaust temperature of the engine is below a predetermined value (e.g., less than 5° C.). When exceeding the predetermined value (e.g., greater than 5° C.), the thermal switch closes, energizing the solenoid 218.

Figure 10:
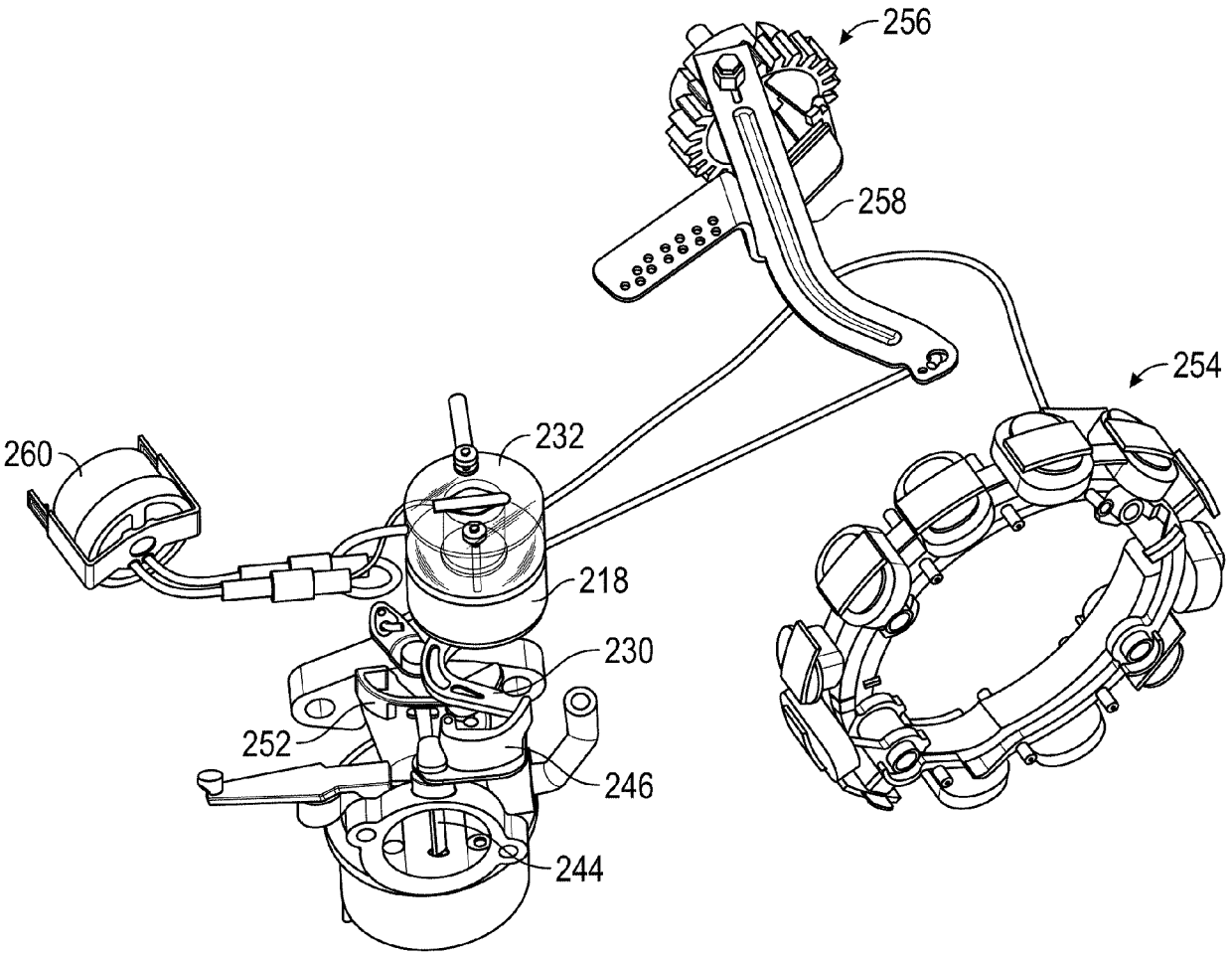
FIG. 10 is a perspective view of the air/fuel mixing apparatus in a warm configuration, according to an exemplary embodiment.

FIG. 10 shows the system after the engine has warmed up to operating temperature. After the ambient or exhaust temperature reaches the predetermined value (e.g., 5° C.), the thermal switch closes to energize the solenoid 218 which, in turn, pivots the choke lever 246 to place the choke valve 244 in a substantially-open position. In this configuration, the thermal switch is closed and the solenoid 218 is energized such that, as described above, the choke lever 246 is rotated fully by the lever arm 230 and choke valve 244 is in a substantially-open position allowing air into the carburetor. The thermostatic coil element 236 continues to expand due to increase in engine temperature.

Figure 11:
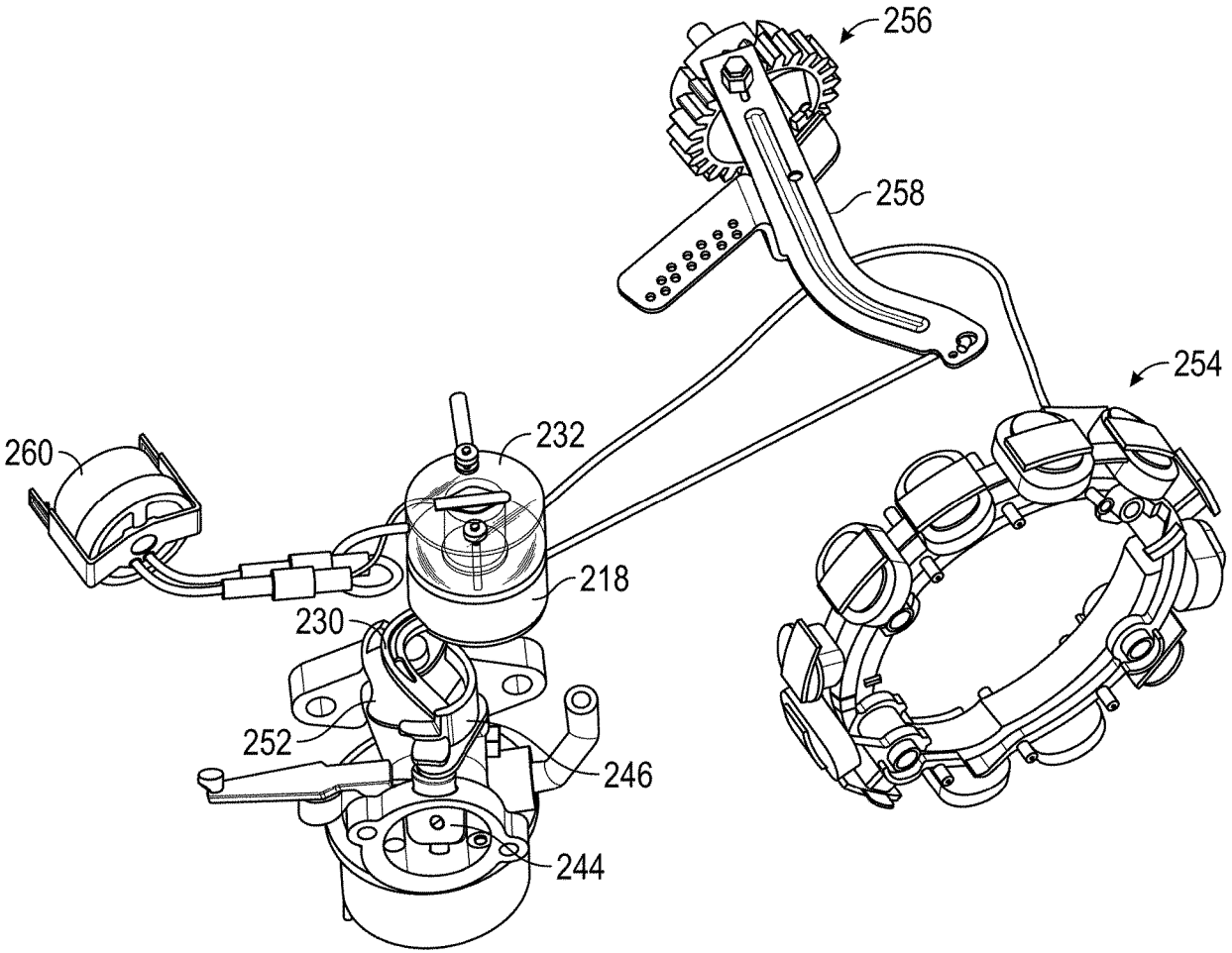
FIG. 11 is a perspective view of the air/fuel mixing apparatus in a warm restart configuration, according to an exemplary embodiment.

FIG. 11 shows the system under a "warm" engine restart configuration, similar to the configuration described in FIGS. 6A and 6B. In this scenario, the engine may have been turned off but has not entirely cooled. The position of the choke valve 244 is set by the thermostatic element 236 warmed by operation. During operation, the thermostatic element 236 expands and the free tab 235 contacts restriction surface 242, thereby acting to rotate shaft 228 in a counter-clockwise direction. This, in turn, acts to hold choke valve 244 slightly open. The thermal switch remains closed above a predetermined temperature (e.g., −1° C.) such that when the engine is restarted, the solenoid will energize.

Figure 12:
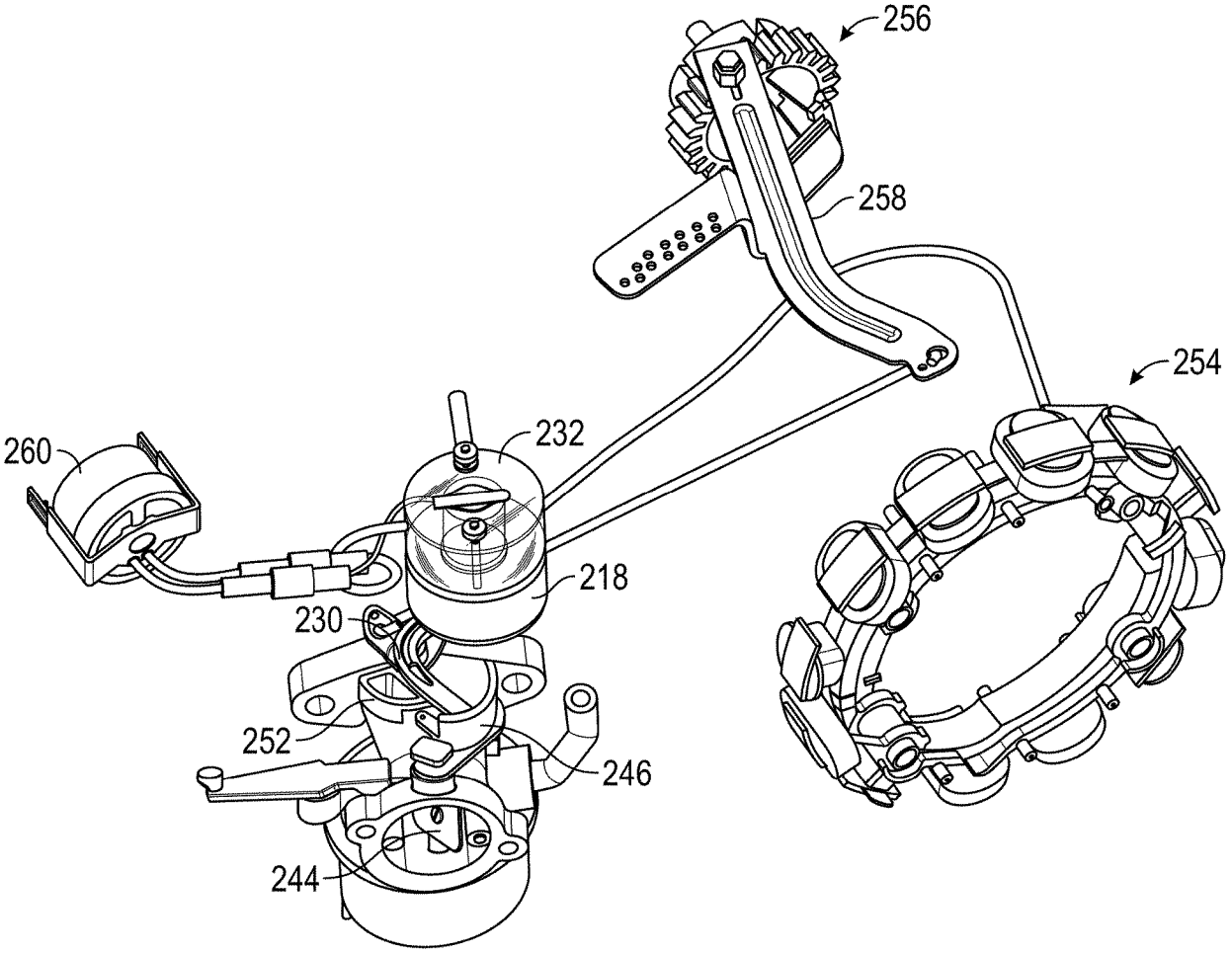
FIG. 12 is a perspective view of the air/fuel mixing apparatus in a hot restart configuration, according to an exemplary embodiment.

FIG. 12 shows the system under a "hot" engine restart configuration, similar to the configuration described in FIGS. 7A and 7B. In this scenario, the engine has only recently shut down, and thus the engine is still hot and ambient temperatures are still elevated. Here, thermostatic element 236 again expands to cause rotation of shaft 228 and thus open choke valve 244 even beyond the "partially opened" position shown in FIG. 6B and FIG. 11. However, in this scenario, travel regulator 238 contacts the thermostatic coil element 236 at free tab 255, thereby limiting the overall rotation of shaft 228, and thus limiting the amount that choke valve 244 may be opened. As noted above, in cold weather applications, this configuration is desirable because even in "hot" restart conditions with elevated engine temperatures, it is still desirable to limit the choke valve opening at restart. The solenoid 218 activates as soon as the engine is restarted due to the thermal switch being closed above a predetermined temperature (e.g., −1° C.).

It is to be understood that during normal operation of the engine, solenoid 218 is configured to fully open choke valve 244, as is described in U.S. Pat. No. 7,628,387. However, in accordance with the exemplary embodiment, upon engine shutdown, travel regulator 238 does not allow thermostatic element 236 itself to fully open choke valve 244. This restriction of fully opening choke valve 244 enables the engine to restart more effectively in cold-weather applications.

Although the present disclosure has been described with reference to example embodiments, workers skilled in the art will recognize that changes may be made in form and detail without departing from the spirit and scope of the defined subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in technology are foreseeable. The present disclosure described with reference to the example embodiments and set forth in the following definitions is manifestly intended to be as broad as possible. For example, unless specifically otherwise noted, the definitions reciting a single particular element also encompass a plurality of such particular elements.

What is claimed is:

1. An air/fuel mixing apparatus configured for use with an internal combustion engine comprising:

a carburetor comprising:

a body defining a passageway therethrough; and a choke valve positioned in the passageway, wherein the choke valve is rotatable about a first vertical axis in response to movement of a choke lever, and wherein the choke valve is rotatable between a choke open position and a choke closed position;

a solenoid configured to move the choke valve between the choke open position and the choke closed position, wherein the solenoid comprises:

a rotary shaft coupled to the choke lever;

a thermostatic element fixedly attached at a fixed end to the rotary shaft, wherein the thermostatic element expands and constricts based on a temperature of the engine, wherein the thermostatic element restricts the movement of the choke valve between the choke closed position and a partially-open position when the solenoid is not energized; and a thermal switch coupled to the solenoid configured to open below a predetermined temperature and close above the predetermined temperature, wherein the thermal switch is configured to de-energize the solenoid when open and energize the solenoid when closed thereby moving the choke valve to the choke open position.

2. The air/fuel mixing apparatus of claim 1, wherein the carburetor further comprises a throttle valve positioned in the passageway downstream of fuel injection into the carburetor and coupled to a throttle lever, wherein the throttle valve is rotatable about a second vertical axis in response to movement of the throttle lever, and wherein the throttle valve is rotatable between a throttle open position and a throttle closed position.

3. The air/fuel mixing apparatus of claim 2, further comprising a governor including a governor arm coupled to the throttle lever, wherein the governor arm moves the throttle lever between the throttle open position and the throttle closed position based on a load of the engine.

4. The air/fuel mixing apparatus of claim 1, wherein the thermostatic element expands when the temperature of the engine increases and constricts when the temperature of the engine decreases.

5. The air/fuel mixing apparatus of claim 1, wherein the thermostatic element further comprises a first tab on a first end of the thermostatic element and a second tab on a second end of the thermostatic element, wherein the first tab moves in relation to an expansion and a constriction of the thermostatic element, and wherein the second tab is attached to the rotary shaft of the solenoid and does not move in relation to the expansion and the constriction of the thermostatic element.

6. The air/fuel mixing apparatus of claim 5, further comprising a cover coupled to the solenoid and configured to house the thermostatic element, wherein a restriction surface is formed on an inside of the cover.

7. The air/fuel mixing apparatus of claim 6, wherein the first tab is movable between a first position and a second position, wherein when in the second position the first tab contacts the restriction surface.

8. The air/fuel mixing apparatus of claim 6, further comprising a travel regulator attached to the rotary shaft, wherein the travel regulator restricts the amount of rotation that the thermostatic element imparts on the rotary shaft coupled to the choke valve when the first tab of the thermostatic element contacts the travel regulator.

9. The air/fuel mixing apparatus of claim 6, wherein when the solenoid is not energized and the thermostatic element is fully expanded, the first tab of the thermostatic element contacts the restriction surface and the choke valve is in the partially open position.

10. The air/fuel mixing apparatus of claim 9, wherein when the solenoid is not energized and the thermostatic element is fully constricted, the first tab of the thermostatic element is not in contact with the restriction surface and the choke valve is in the choke closed position.

11. The air/fuel mixing apparatus of claim 8, wherein at a first engine temperature for a cold start condition, the thermal switch is open and the first tab is not in contact with the restriction surface and the travel regulator is not in contact with the first tab.

12. The air/fuel mixing apparatus of claim 11, wherein at a second engine temperature for a warm start condition, the thermal switch is open and the first tab is in contact with the restriction surface and the travel regulator is in contact with the first tab.

13. The air/fuel mixing apparatus of claim 12, wherein at a third engine temperature for a running condition, the thermal switch is closed and the solenoid is energized, wherein the solenoid opens the choke valve to the choke open position.

14. The air/fuel mixing apparatus of claim 1, wherein the thermostatic element is a coil wound around the rotary shaft of the solenoid.

* * * * *